US006695445B2

(12) United States Patent
Hagstrom et al.

(10) Patent No.: US 6,695,445 B2
(45) Date of Patent: Feb. 24, 2004

(54) PRINTER FOR LARGE SHEETS OF PRINT MEDIA

(75) Inventors: Erick Hagstrom, Medina, MN (US); Robert P. Cummins, Deephaven, MN (US); Michael R. Tolrud, Chaska, MN (US)

(73) Assignee: Primera Technology, Inc., Plymouth, MN (US)

( * ) Notice: Subject to any disclaimer, the term of this patent is extended or adjusted under 35 U.S.C. 154(b) by 27 days.

(21) Appl. No.: 10/008,426

(22) Filed: Nov. 13, 2001

(65) Prior Publication Data

US 2003/0090556 A1 May 15, 2003

(51) Int. Cl.[7] ..... B41J 2/01
(52) U.S. Cl. ..... 347/104; 347/37; 400/23
(58) Field of Search ..... 347/104, 37; 400/23, 400/24, 29, 31, 34, 44, 27; 226/8; 346/29

(56) References Cited

U.S. PATENT DOCUMENTS

| | | | | |
|---|---|---|---|---|
| 3,767,020 A | | 10/1973 | Rowe | 197/1 R |
| 3,968,498 A | * | 7/1976 | Uchiyama | 346/29 |
| 4,118,129 A | | 10/1978 | Grundherr | 400/144.2 |
| 4,978,979 A | | 12/1990 | Asakawa | 346/140 R |
| 5,446,559 A | | 8/1995 | Birk | 358/473 |
| 5,685,651 A | | 11/1997 | Hayman et al. | 400/88 |
| 5,710,580 A | * | 1/1998 | Otsuka et al. | 347/32 |
| 5,859,653 A | | 1/1999 | Aoki et al. | 347/8 |
| 6,116,707 A | | 9/2000 | Avida | 346/139 R |

FOREIGN PATENT DOCUMENTS

| | | |
|---|---|---|
| WO | WO 89/09140 | 10/1989 |

* cited by examiner

*Primary Examiner*—Stephen D. Meier
*Assistant Examiner*—Ly Tran
(74) *Attorney, Agent, or Firm*—Westman, Champlin & Kelly, P.A.

(57) ABSTRACT

A printer is arranged to be self propelled for movement on a surface of a sheet on which printing is to take place. The printer is independently driven, while the sheet is held stationary, and does not have to be fed the sheet. The sheet can be oriented in a home position and indexed relative to a frame carrying the printer so that the printhead on the printer will print a line at a time perpendicular to the direction of travel of the frame.

11 Claims, 8 Drawing Sheets

PRINTER FOR LARGE SHEETS OF PRINT MEDIA

BACKGROUND OF THE INVENTION

The present invention relates to a printer that is used with oversized printable sheets, such as a poster, foam backboard or similar materials that are large, and are preferred to be on boards that are not bent or easily driven through rolls. The printer is mounted onto a frame that is driven independently over and along the surface of the printing substrate, such as a tag board or the like, while the board remains stationary. The printer is preferably an ink jet printer, that is synchronized with a forward drive for the printer.

At the present time, printing posters has been a difficult task because the posters are large, and most printers do not accommodate wide substrates or papers and, also, most printers do not provide for feeding a flat substrate through the printer. Printers that are developed for large substrates are very expensive, and thus are not readily used by people that are making posters.

SUMMARY OF THE INVENTION

The present invention relates to a printer for printing large area sheets of print media or substrates, such as posters, where the print media remains on a flat support and the printhead is driven on a standard printer head across the surface as it prints. The print media or substrate remains stationary, and can be supported on a suitable table, and once the printer frame and printhead is oriented at a home position and the print media is also positioned at a reference or home position, the frame will move across the print media substrate uniformly to provide for transverse movement of the printer for printing the images (such as a poster or graphic print) under a printer control.

Standard printheads can be used, as shown an ink jet printer, but the support or frame for the printhead is elongated to accommodate the width of the print media sheet that is desired.

The print media sheet can be supported on any planar surface, and can be positioned so that the print media sheet will have one traverse edge at a known location or start position, while the printer is positioned in a home position relative to the known or start edge of the print media sheet so that the printer frame is square with the longitudinal edges of the substrate.

Once the print media sheet and the printer are properly aligned, the printer is started. The printhead is driven transversely along the printer frame as is now done, and the frame is also driven longitudinally along the sheet with a variable speed DC motor, or a stepper motor. The printer moves along the longitudinal length of the sheet which is the travel direction axis of the printer. The travel direction is perpendicular to the movement of the printhead along the printer frame. The printhead moves laterally across the print media sheet at each step or increment of movement of the printer frame as it is driven along the longitudinal length to complete the printing for that particular line, in a normal manner. The printer frame is incrementally driven along the entire length of the sheet to complete the print job.

Standard printheads and printhead drives can be utilized, and the printhead support frame is extended in length to the desired length for the width of the sheet to be printed. Poster boards that are in the range of 22–24" in width, plus any desired length, can be printed. Wider widths can be printed as well, with the frames modified for adequate support along the wider widths. The print media sheet can be any thickness desired for posters or the like, and the printer easily accommodates foam backed poster boards.

The drive for moving the printer frame can be made as desired, but high friction material rollers are shown and are utilized for driving against the printing surface. The rollers should be non-marking. The program control for the printing program can be a program in a personal computer or other computer operating in a known manner. The printer can be guided on side rails that support the printer and driven along the rails or it can be supported on the rails and driven as shown.

DETAILED DESCRIPTION OF THE ILLUSTRATIVE EMBODIMENTS

Figure 1:
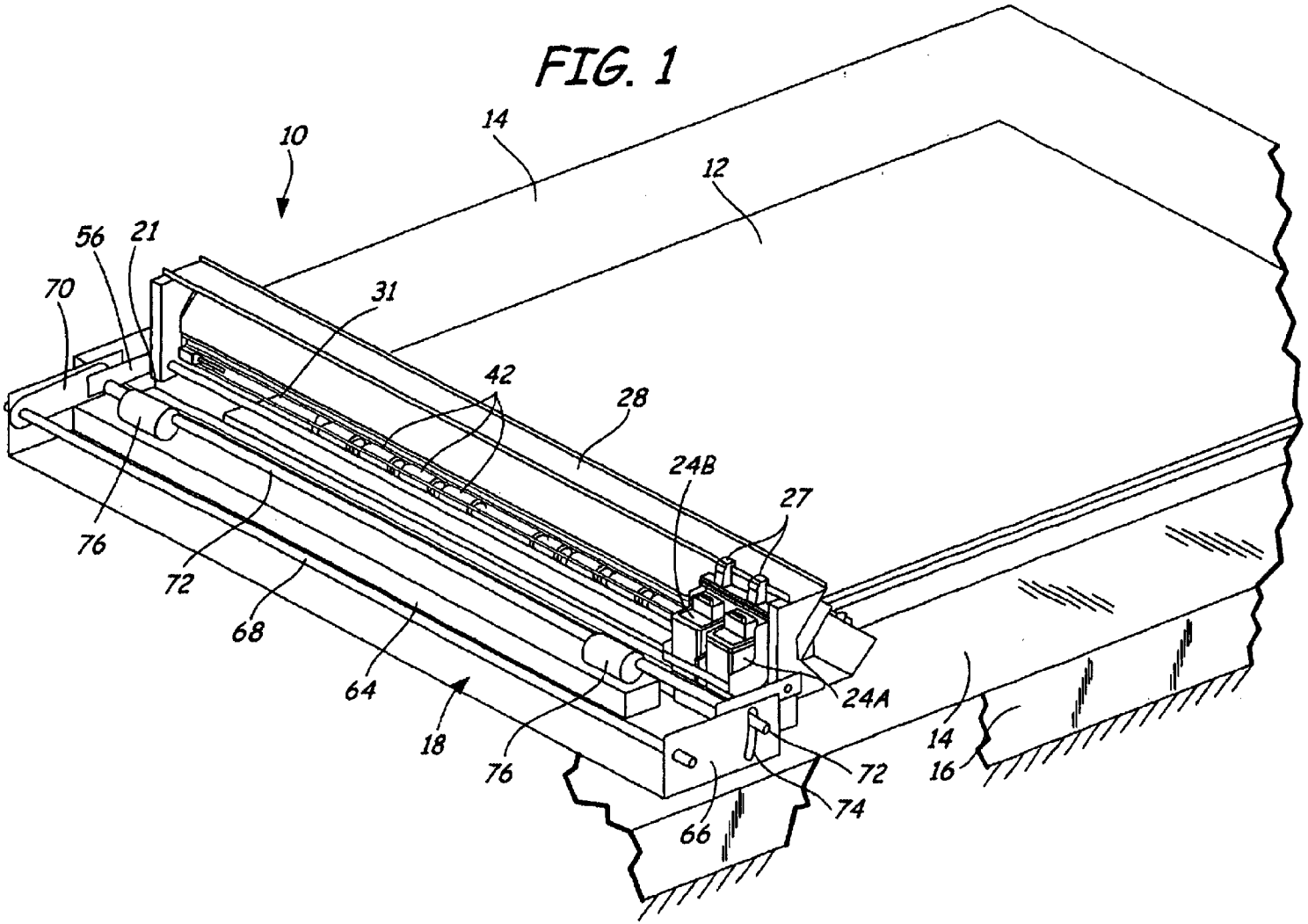
FIG. 1 is a rear perspective view of a printer made according to the present invention in a home position on a poster board print sheet.
Figure 4:
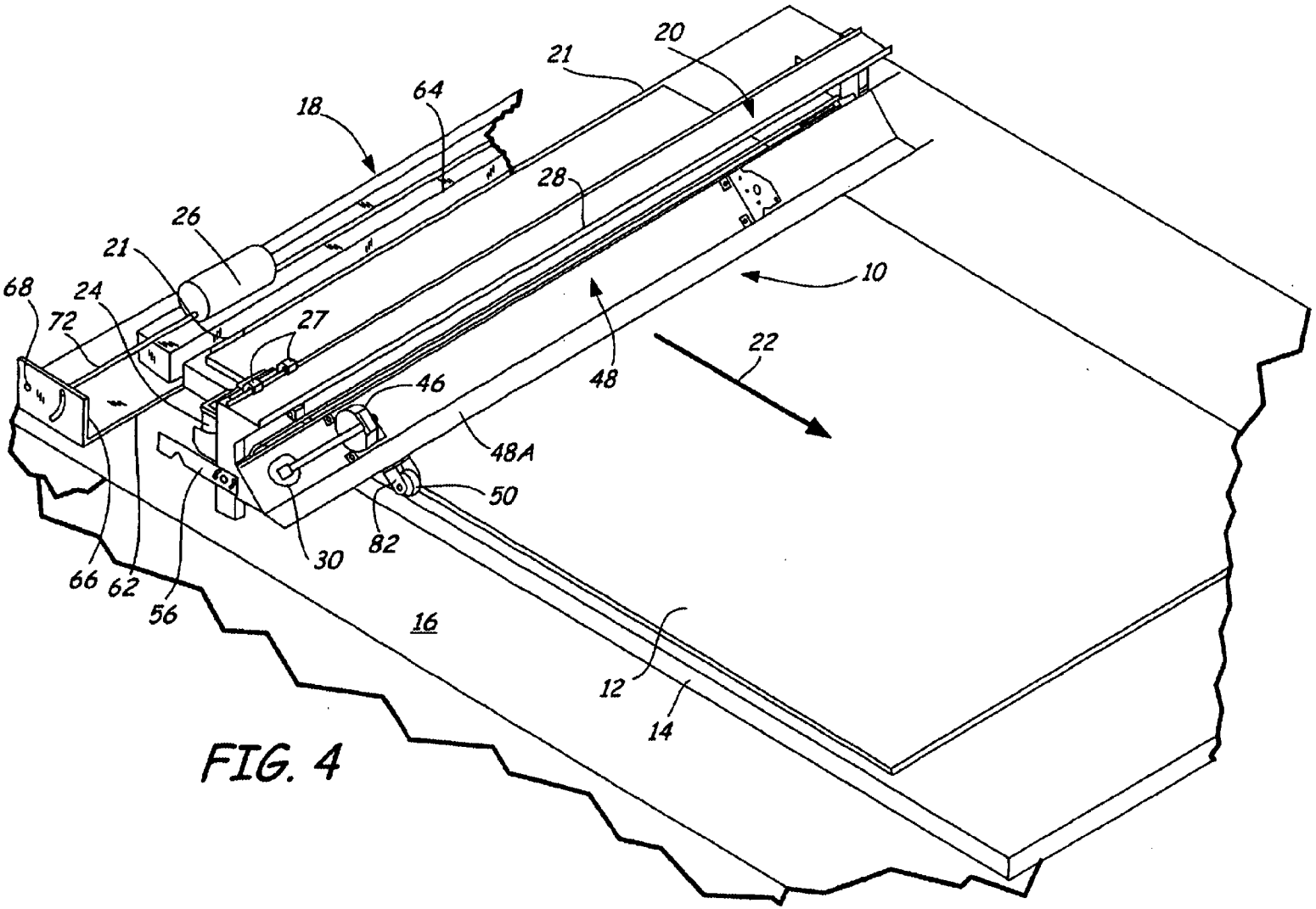
FIG. 4 is a print perspective view of the printer of the present invention in a home position.
Figure 5:
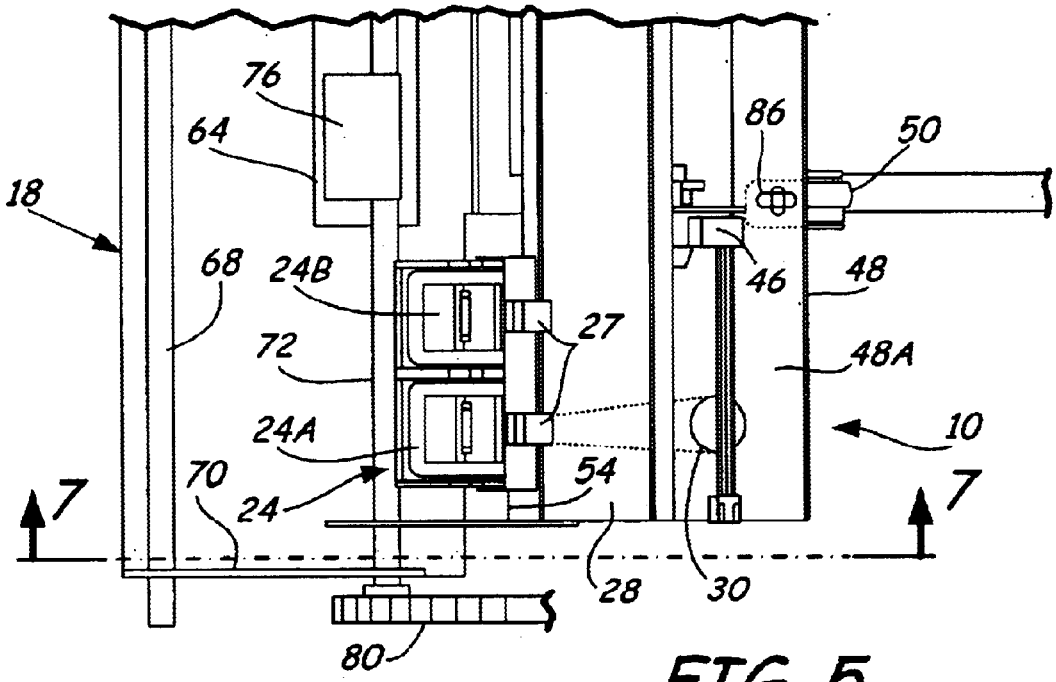
FIG. 5 is a fragmentary top view of the drive end of the printer of the present invention in the home position.
Figure 6:
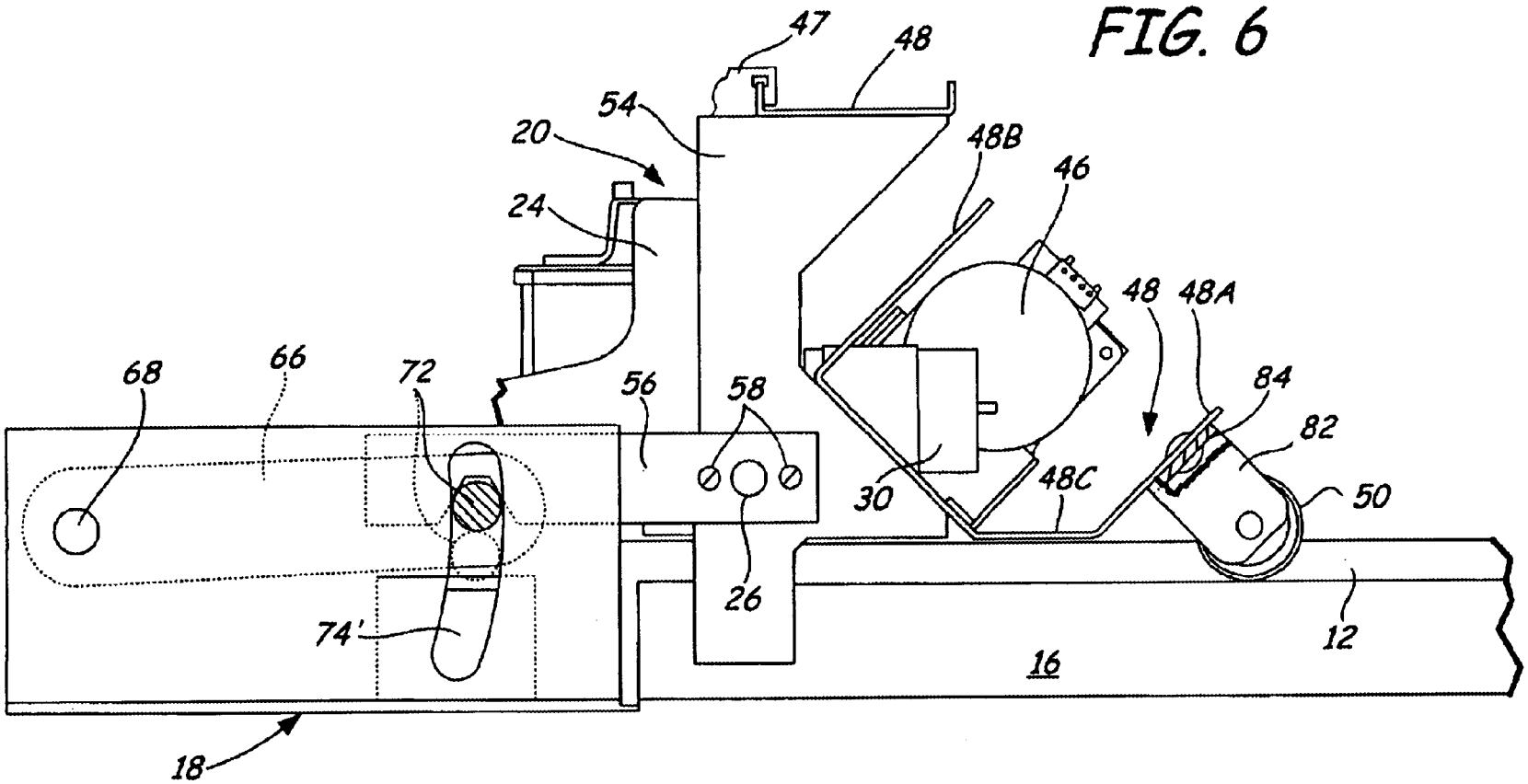
FIG. 6 is an enlarged side view of the printer in home position.

FIG. 1 illustrates a printer assembly 10 that is used for printing on a large print media sheet or substrate 12. The substrate 12 is supported on a flat platen or support 14 that can be positioned on suitable main supports such as a table or frame 16. Table 16 also supports a home position docking frame (FIGS. 1, 6 and 7) that is used to orient the printer 10 relative to a print media sheet 12 that is located in a known position on support 14. A printer frame 20 is positioned precisely perpendicular to the drive direction or travel which is indicated by the arrow 22 (FIG. 4). The print media sheet "start" edge can be positioned against one continuous rib like vertical guide 21 on the support 14 (FIG. 1). The rib 21 can be in sections if desired. The drive for a printhead 24 on the printer frame is along an axis that is perpendicular to the direction of movement of the printer frame on the print media sheet represented by arrow 22.

Figure 2:
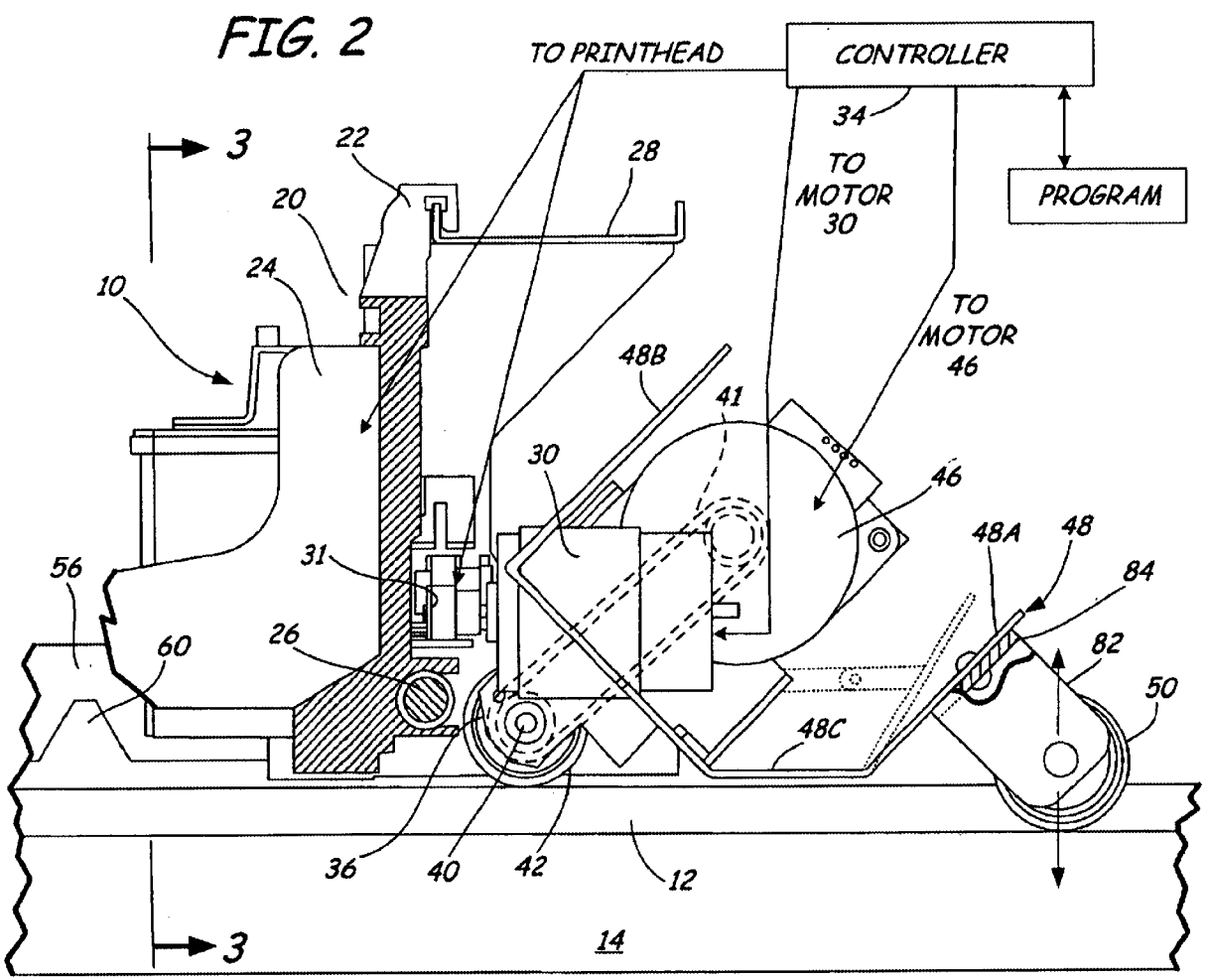
FIG. 2 is a fragmentary enlarged side elevational view of the printer shown in FIG. 1 in its printing path with a side panel broken away.
Figure 3:
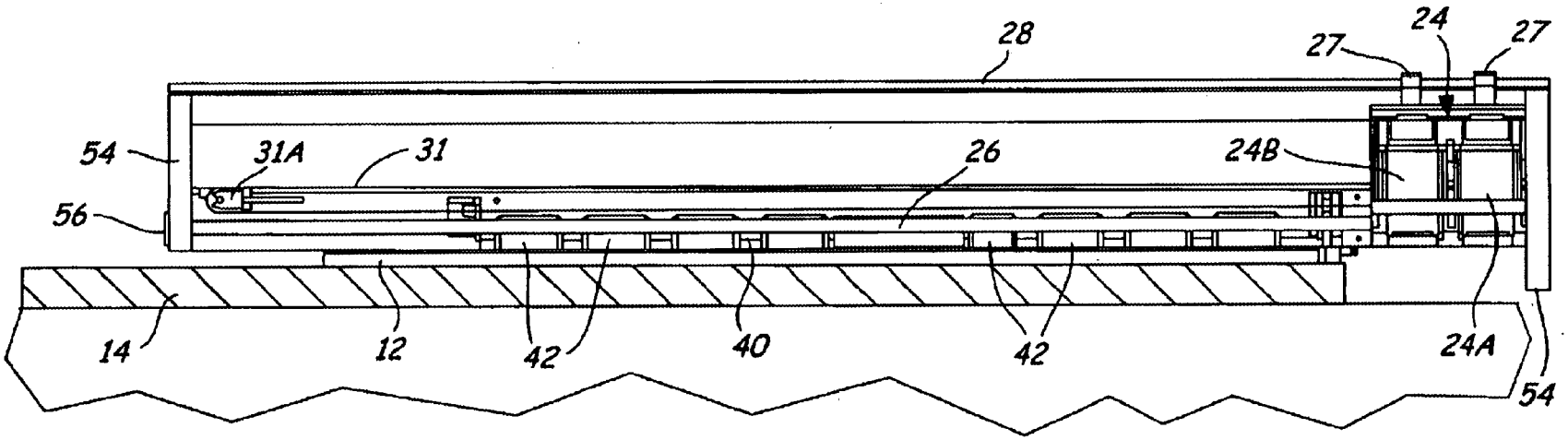
FIG. 3 is a sectional view of the printer taken generally along line 3—3 in FIG. 2.

The printhead preferably is an ink jet printhead 24 that is mounted on a guide shaft 26 (FIG. 2) that is a conventional mounting for the printhead 24. The printhead also has hook-like guides 27 that slide along a leg of a frame cross channel 28. The printhead 24 carries two ink cartridges 24A and 24B as is well known, and is provided with control signals through a flat ribbon cable of conventional design (not shown) that is of sufficient length so that the cable follows the printhead all the way along the length of the frame 20 and channel 28.

The printhead is driven along the frame 20 by a motor 30 that drives a belt 31, which is connected to move the printhead back and forth along the frame on shaft 26. The belt 31 is mounted on a pulley on motor 30 and on an idler pulley 31A at the opposite end of the frame. The motor 30 and the printhead are operated by control signals from a controller 34 that can be a PC or other control computer that has the printing program.

The printer frame 20 includes support hubs 36 that rotatably mount a drive shaft 40 positioned at the bottom of the frame. The drive shaft 40 has a series of rubber or high friction surface drive rollers 42 drivably mounted thereon. The rollers 42 can be spaced at regular intervals along the length of the print frame, which is the transverse (perpendicular) to the direction of movement of the frame on the sheet 12, and parallel to the travel of the printhead on frame 20.

The shaft 40 is driven by a reversible motor 46 that can be a stepper motor, or a reversible DC drive motor, that is very precisely controlled by controller 34 so that it will move the frame 20 uniformly in direction as indicated by the arrow 22 for one print line at a time. The drive to shaft 40 and rollers 42 can be a belt 41 mounted on pulleys on the motor shaft and on shaft 40 (see FIG. 2). After the frame 20 is advanced, the printhead 24 will make a pass by moving along shaft 26 to print the line under control from the controller 34, and once that pass has been made or if needed for color, more than one pass is made at one position of the frame, then the motor 46 would be driven to advance the printer frame the necessary length or distance for printing an additional line.

The printing is the same process that is carried out with standard ink jet printers, such as those made by Lexmark, Inc. The Lexmark ink jet printhead, printhead drive and printing program controls can be utilized, with the frame being extended to make sure that it spans the necessary width of print media sheet surface.

The frame 20 includes a structural panel 48 extending along the frame at the forward side. A stabilizing wheel 50 is mounted on a yoke 82 onto the end portion of the panel 48 to be alongside the print media sheet 12. The guide wheel 50 thus runs along the surface of platen or support 14 and insures that the frame 20 is stably supported as it is driven by motor 46 and as the printhead 24 is driven for printing.

The home position of the printer frame 20 is established at the docking station 18, and as shown, in addition to having longitudinal members such as the structural panel 48, and the channel 28, the frame has side plates 54 mounted thereon. The side plates 54 are securely mounted onto the structural panel 48, and other cross members. As can be seen in the side views, such as FIG. 2 and FIG. 7, the structural panel 48 is essentially a channel shaped member having leg 48A and 48B that provide for strength and stability of the frame. The guide wheel 50 is mounted onto leg 48A.

Figure 9:
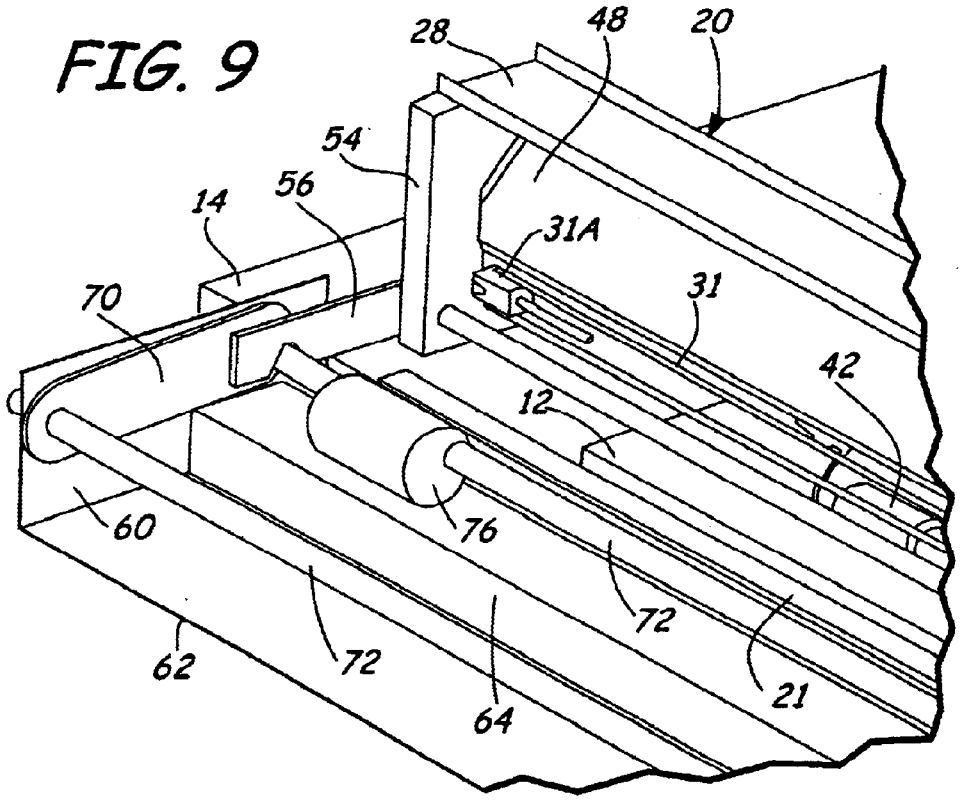
FIG. 9 is an enlarged fragmentary rear view of an opposite end from FIG. 8.

The side plate 54 on each side of the frame supports a lift arm 56 which is rigidly connected with suitable fasteners 58 to the respective side plate 54. The arms 56 extend rearwardly from the printer frame 20, as can be seen in the illustrations, and have a locating notch or groove 60 on a lower edge thereof. The docking station 18 includes a base 62 that supports a cam reaction bar 64. The base 62 has upright end ears or panels 66 at opposite ends thereof, as can be seen in FIG. 1, and also as illustrated in FIGS. 4 and 9.

Figure 7:
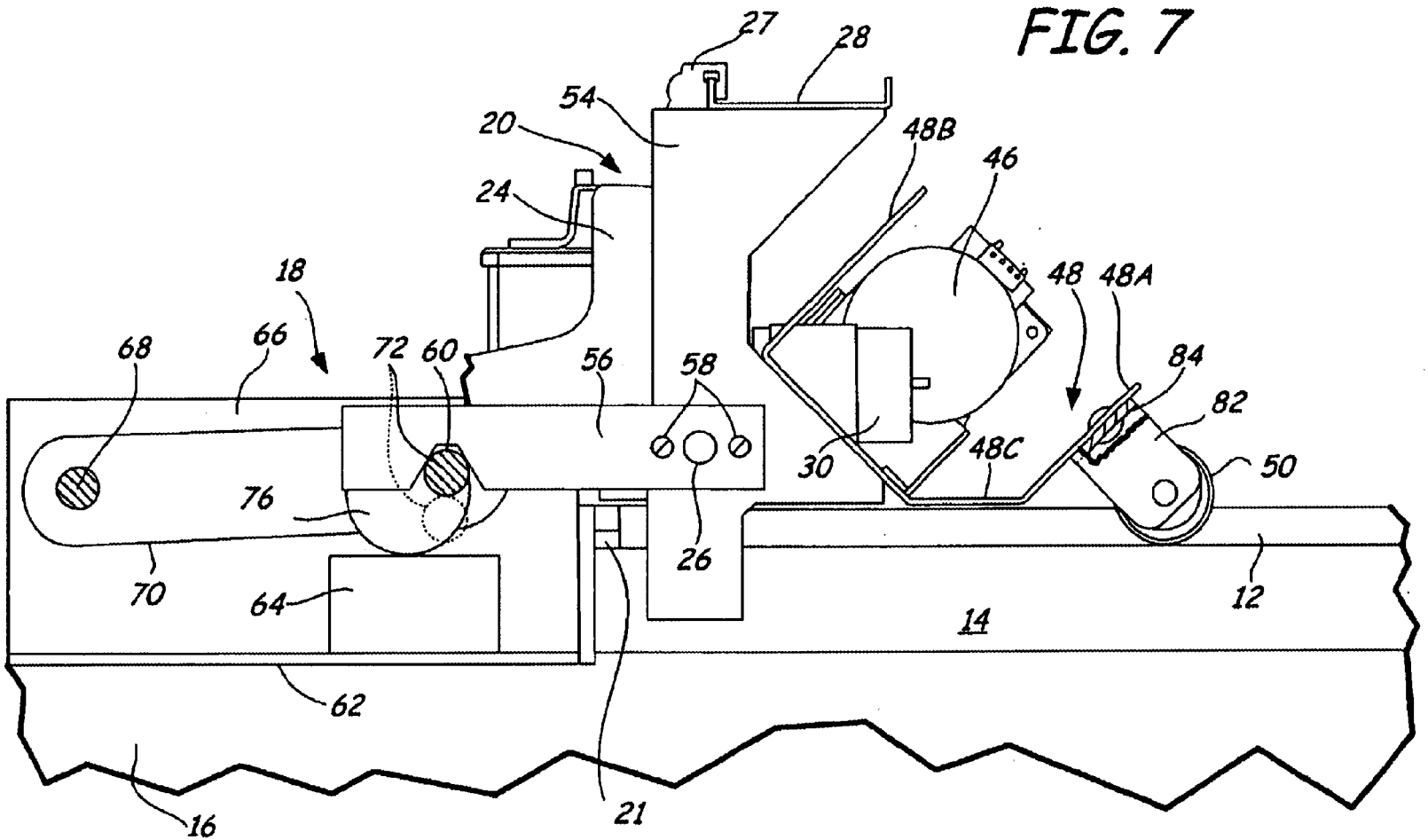
FIG. 7 is a sectional view taken on line 7—7 in FIG. 5.
Figure 8:
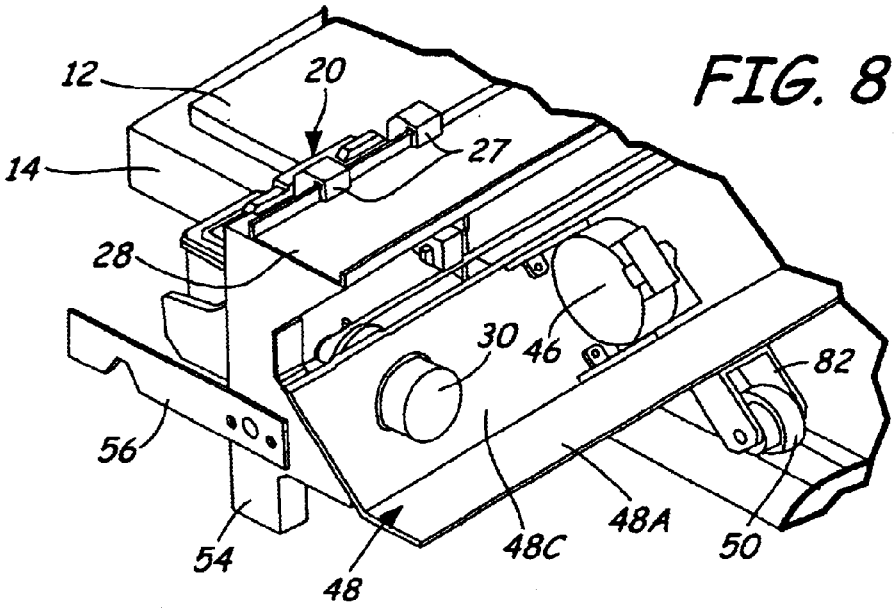
FIG. 8 is an enlarged fragmentary front view of the drive end of the printer.

A cross shaft 68 is mounted between the upright ears or panels 66, and the cross shaft 68 is used for mounting a pair of pivoting arms 70, at opposite ends of the shaft 68. These pivoting arms 70 in turn mount a cam shaft 72 that extends out through guide slots 74 on the ears or panels 66, and a pair of roller type cams 76 are mounted on the cam shaft 72 adjacent the opposite ends of the cam reaction bar 64. The cams 76 are positioned to ride an upper surface of the cam reaction bar or block 64, and as can be seen in FIGS. 1, 4 and 7, the cam shaft 72 is eccentrically mounted on the cams 76. That means that as the cam shaft 72 is rotated by a cam shaft drive lever 80, the position of the cam shaft will change relative to the upper surface of the bar 64, and will move down to a lowered position shown in dotted lines in FIG. 7, wherein the cam shaft will be adjacent to the top of the bar. The cam shaft 72 will be below the lower edge of the arms 56. In the solid line position shown in FIG. 7, it can be seen that the cam shaft has been raised and has entered into the slot or receptacle 60, which has tapered lead-in edge surfaces that permit the cam shaft 72 to move upwardly to hold the arms 56, and thus the entire frame 20 in a secure position. The cam shaft will lift the rear portions of the printer frame as the guide wheel 50 supports the forward edge. The pivoting arms 70 provide for a stable guide for the cam shaft, as it moves between its lowered position shown in dotted lines in FIGS. 2 and 7 and its partially raised position that is shown also in FIG. 7 in solid lines.

The raising of the cam shaft 72 farther upwardly from the position shown in FIG. 7 will cause the printer frame to tilt upwardly about the stabilizing wheel 50, so that the drive rollers 42 will raise up from the upper surface of the print media sheet or board shown at 12, and the print media sheet can then be moved out after the printer frame 20 has returned to its home and docked position, and the cam shaft is operated. Then a new print media sheet can be put into place.

The cam shaft 72 would then be lowered to release the printer. The printer itself is then properly oriented because of its positioning at its home position by the cam shaft 72, which is held securely and at a proper orientation relative to the print media sheet, when the print media sheet is properly aligned against the backing or indexing rib 21, or along suitable guidelines.

Cam actuator 80 can be a manual lever, or it can be a lever operated with a motor drive. If it is operated with a motor drive the links or other drive must be capable of moving along the arc of the cam shaft movement. For example, a motor could be mounted to have its drive shaft coaxial with the pivot arm 68, and a belt and pulley arrangement could then be used for rotating the cam shaft 72 under control of the controller 34.

To accommodate different thicknesses of the print media sheet, the stabilizing wheel 50 can be adjustable in more than one way. As shown, the stabilizing wheel 50 is held in yoke 82, that has a cross member 84 resting against the under surface of the leg 48A of the structural panel 48. The leg 48A can have a slot shown at 86 that permits adjusting the yoke 82 along the panel using a screw or bolt for fastening the yoke 82. In this manner the front portion of the frame, for example, the portion 48C of the panel 48 can be raised and lowered relative to the upper surface of the print media sheet 12. Additionally, the panel 48A can be hinged relative to the panel 48C and controlled with a mechanical strap or the like.

Other ways of changing this position of the stabilizing wheel of course can be utilized, as desired.

The printer frame thus can be driven for any desired longitudinal length along a print media sheet. The length of the frame transverse to the direction of travel or movement of the printhead can be adjusted to work on any desired width of sheet as long as the frame is strong enough to support the printheads without sagging. Various supports can be made back to the shaft 40 that supports the drive rollers 42, as well.

The present disclosure illustrates a printer that has drive rollers engaging the sheet surface and is not guided with rails. The printer frame can be supported on or guided by rails and the drive members can be engaging the rails for driving. The frame can also be driven as shown and guided by rails.

Although the present invention has been described with reference to preferred embodiments, workers skilled in the art will recognize that changes may be made in form and detail without departing from the spirit and scope of the invention.

What is claimed is:

1. A printer for printing on a sheet having a printable surface comprising a frame having an axis extending laterally across the printable surface, a drive for moving the frame along the printable surface in a direction generally perpendicular to the axis of the frame a shaft extending along the axis of the frame, drive rollers on the shaft that engage the printable surface, a printhead mounted on said frame for traversing the frame in direction along the frame axis, a drive motor on the frame for driving the shaft and drive rollers and thereby moving the frame along the printable surface in the desired direction as the motor is driven, and a controller controlling the printhead to print on the printable surface coordinated with the movement of the frame along the printable surface.

2. The printer of claim 1, wherein said drive comprises a shaft extending along the axis of the frame, and a drive motor on the frame for driving the shaft.

3. The printer of claim 1, wherein the motor is reversible.

4. The printer of claim 1, wherein said sheet having the printable surface is positioned at a home position on a support, and an indexing device for indexing the printer frame to orient the printer frame relative to the sheet in the home position.

5. The printer of claim 4, wherein the device for indexing the printer frame comprises at least one locator arm fixed to the frame, the locator arm having a notch on a lower edge, and a shaft movable from a raised position to a lowered position, said shaft clearing said indexing arm in the lowered position and engaging the notch in the raised position to locate the printer at a desired home location.

6. The printer of claim 5, wherein said shaft is operated by a cam reacting on a surface fixed with respect to a support for the printable sheet, said cam moving the shaft between its raised and lowered positions as the shaft is rotated.

7. The printer of claim 4, wherein said indexing device comprises a docking station, and wherein the sheet having a printable surface is supported on a support platen that is generally planar, the docking station including a bracket having a pair of arms at opposite ends thereof pivotally mounted onto said support, said pivoting arms being positioned to exterior sides of opposite ends of the printer frame, the printer frame having a pair of fixed arms extending therefrom at the opposite ends of the printer frame, said pivoting arms on said docking station supporting a cam shaft, at least one cam on the cam shaft for moving said cam shaft in an arc established by said pivoting arms on the docking station as the cam shaft is rotated, and the fixed arms on the printer having tapered receptacles on bottom surface thereof, said cam shaft entering said receptacles when the printhead is moved to its home position, and positively locating the printhead along a known axis relative to the axis of the printer frame.

8. A printer for printing on a sheet having a printable surface comprising a frame having an axis extending laterally across the printable surface in a direction generally perpendicular to the axis of the frame, a printhead mounted on said frame comprising a shaft extending along the axis of the frame, a drive motor on the frame for driving the shaft for traversing the frame in direction along the frame axis, a controller controlling the printhead to print on the printable surface coordinated with the movement of the frame along the printable surface, and a stabilizing member on the frame spaced from the shaft for holding the frame oriented relative to the printable surface as the frame is moved.

9. The printer of claim 8, wherein said stabilizing member comprises a wheel that is positioned to one side of the sheet having a printable surface, and which wheel engages and moves along the support for the sheet having a printable surface.

10. The printer of claim 9, wherein said stabilizing wheel is adjustable in a direction to cause the print frame to tilt about the cam shaft when the cam shaft is supporting the fixed arms on the printer.

11. The printer of claim 9, wherein said stabilizing wheel is spaced in the direction of travel of the printer from the drive for moving the frame, and said stabilizing wheel being adjustably mounted so that it changes the position of the frame relative to the drive to provide for adjustment to orient the printhead relative to the printable surface for different thicknesses of sheets having a printable surface.

* * * * *

UNITED STATES PATENT AND TRADEMARK OFFICE

CERTIFICATE OF CORRECTION

PATENT NO. : 6,695,445 B2
DATED : February 24, 2004
INVENTOR(S) : Erick Hagstrom et al.

It is certified that error appears in the above-identified patent and that said Letters Patent is hereby corrected as shown below:

Column 5,
Line 19, after "frame" insert -- comprising --.

Column 6,
Line 15, "surface" should be -- surfaces --.
Line 21, after "surface" insert -- a drive for moving the frame along the printable surface --.

Signed and Sealed this

Fourth Day of January, 2005

JON W. DUDAS
*Director of the United States Patent and Trademark Office*